US005434478A

United States Patent [19]

Kovalsky et al.

[11] Patent Number: 5,434,478

[45] Date of Patent: Jul. 18, 1995

[54] ELECTRONIC BALLAST FOR TRANSILLUMINATORS AND CROSSLINKERS

[75] Inventors: Alvin Kovalsky, Rancho Palos Verdes; Gerald Felper, Anaheim; Thomas A. Almquist, San Gabriel; Ronald E. Repass, Redondo Beach, all of Calif.

[73] Assignee: Ultra-Lum, Inc., Carson, Calif.

[21] Appl. No.: 38,267

[22] Filed: Mar. 29, 1993

[51] Int. Cl.[6] ..... H05B 41/26

[52] U.S. Cl. ..... 315/209 R; 315/DIG. 7; 315/227 R

[58] Field of Search ..... 315/209 R, 227 R, DIG. 7

[56] References Cited

U.S. PATENT DOCUMENTS

| | | | |
|---|---|---|---|
| 4,017,761 | 4/1977 | Woldring | 315/289 X |
| 4,370,600 | 1/1983 | Zansky | 315/209 R X |
| 4,394,603 | 7/1983 | Widmayer | 315/DIG. 7 X |
| 4,523,131 | 6/1985 | Zansky | 315/DIG. 7 X |
| 4,525,648 | 6/1985 | De Bijl et al. | 315/DIG. 7 X |
| 4,847,535 | 7/1989 | Wisbey et al. | 315/101 |
| 4,937,502 | 6/1990 | Pro | 315/209 R |
| 4,996,462 | 2/1991 | Krummel | 315/209 R |
| 5,004,947 | 4/1991 | Nilssen | 315/224 |
| 5,004,959 | 4/1991 | Nilssen | 315/209 R X |
| 5,089,925 | 2/1992 | Lester | 361/84 |
| 5,359,274 | 10/1994 | Bandel | 315/DIG. 7 X |

*Primary Examiner*—Tony M. Argenbright

*Attorney, Agent, or Firm*—Irving B. Osofsky

[57] ABSTRACT

A low cost multipurpose electronic ballast for ultraviolet transilluminators and crosslinkers for starting and operating four or more ultraviolet lamps simultaneously. The electronic ballast is designed to be capable of operating with input voltages ranging from 85 volts AC to 250 volts AC and input frequencies ranging from 40 Hertz to 400 Hertz. The output to the lamps comes from a group of capacitors which control the current to the lamps. Because the output comes from capacitive ballasts in parallel, alternate sets of capacitors can be switched to alternate sets of lamps allowing the central ballast control to be used with different sets of lamps. By placing another set of capacitors in parallel with the existing output capacitors and making a momentary connection, a momentary power boost can be achieved. This feature also allows a variable intensity control comprised of a number of different size capacitors in series with the parallel group to vary the total current to all the lamps. Variable intensity can also be accomplished by reducing the input voltage with a variable resistor. These variable intensity controls can not reduce intensity to zero, but provide sufficient intensity variation range for the application. Changing the output capacitors provides the required current for different lamp wattages. This application is specifically designed for use with ultraviolet transilluminators and crosslinkers, allowing features not previously available. It is not beneficial for industrial lighting.

13 Claims, 4 Drawing Sheets

ELECTRONIC BALLAST FOR TRANSILLUMINATORS AND CROSSLINKERS

BACKGROUND OF THE INVENTION

1. Field of the Invention

The present invention relates generally to the field of ballast circuits for groups of ultraviolet lamps. The invention specified relates particularly to applications using four or more ultraviolet lamps and several unique application features it can provide in ultraviolet transilluminators and ultraviolet crosslinkers.

2. Description of Prior Art

Transilluminators and ultraviolet crosslinkers utilize ultraviolet lamps in their measurements of electrophoresis. Electrophoresis is an analytical tool that is used in the study of bacteria, viruses, and in protein differentiation, purification and nucleic acid studies. Electrophoresis involves the separation of charged molecules under the influence of an applied electric field.

Visualization of electrophoresis with a transilluminator occurs by the optical absorption method or by the fluorescence method using an ultraviolet transilluminator.

Alternatively, electrophoresis is also conducted with a crosslinker as follows: Nucleic acid transferred to a membrane is exposed to ultraviolet light which causes formation of a stable bond between bound molecules and the nylon membrane.

All of the present commercial transilluminators and crosslinkers use fluorescent ultraviolet lamps that utilize electromagnetic ballasts. With these electromagnetic ballasts the tubes will flicker momentarily while they light. This flicker period will vary as some function of how long the unit has been on and the flicker period will vary with aging of the ultraviolet lamps. Such flicker is undesirable in the transilluminator when visualization of a gel requires differentiation of shadings. The flicker is undesirable in the crosslinker where the calibration is determined by measuring the output intensity over a time period. Such flicker is undesirable in devices that must put out a measured repeatable pulse of ultraviolet illumination.

Ultraviolet lamps used in these devices are basically fluorescent lamps that have a negative internal resistance characteristic once the gas in the lamp is ionized. This means that as current increases through the lamp, the resistance of the lamp decreases. This resistance decrease causes the current to further increase so that, unless some current-limiting ballast is provided, the lamp will be destroyed by excess current.

Thus, a ballast system is required which will enable the lamp to operate at a sufficiently high current for proper illumination, but will prevent the current from increasing to a level at which the lamp will destroy itself. In addition, a fluorescent lamp exhibits a very high effective internal resistance until the gas within the lamp ionizes, at which time a much lower resistance is presented. For that reason, the fluorescent lamp requires a high starting voltage in order that the lamp may be ignited.

For many years, iron-core transformer ballast systems have been utilized to control fluorescent lamp current. Such designs were the only economical type available which were capable of providing a high starting voltage and at the same time, capable of limiting the operating current to an appropriate level. These iron-core ballast circuits were used extensively despite undesirable characteristics including low power efficiency, an audible buzz and high weight.

There have been a number of approaches to improve the efficiency of fluorescent lamp ballast systems. The newest approach has led to the development of solid state high-frequency electronic ballast systems. High frequency is advantageous because the ballast system and the fluorescent lamps are more efficient at higher frequencies. Solid state high frequency ballasts have become available to operate ordinary fluorescent lamp fixtures. These recent solid state ballast systems have the advantage over the prior art iron-core ballast with smaller size, lower weight, no audible noise and increased power efficiency. The disadvantage of the solid state ballast is higher cost compared to iron-core ballasts.

This cost difference however is more than compensated for in industrial and commercial lighting systems by the saving in operating electrical energy cost. The existing electronic ballasts are designed for commercial and industrial applications and are not practical for small electronic instrument applications where low cost and small size are major concerns and reduction of power consumption is not important.

The inventors have designed an inexpensive electronic ballast system which is small, flickerless and provides additional features not present in the ballasts used in the electrophoresis measurement industry at the present time. The present invention reduces ballast cost by enabling one ballast control to drive four or more ultraviolet lamps using capacitors on the output lines to control the individual lamp current. Through the use of these capacitors, many other unique features become available and the circuit design is simplified because there is no concern over power factor due to the low power consumption of lamps used in measuring instruments.

3. Description of a Ballast for Fluroescent Lamps

A ballast is a current and voltage regulating device that is used with a fluorescent lamp to perform these main functions:

1. It transforms line voltage to the proper open circuit voltage necessary for a particular lamp that it will operate.
2. It provides a specific amount of electrical energy to preheat the lamp electrodes.
3. It supplies a controlled high voltage to initiate the lamp arc.
4. It controls lamp current and operating voltage within the limits prescribed by the lamp manufacturer.

4. Features of the Non-Flickering Electronic Ballast

1. The electronic ballast is complete on a single small circuit board.
2. The electronic ballast can drive as many as 6 tubes at a time.
3. The electronic ballast can drive different wattage tubes with a minor component change.
4. The electronic ballast operates at a frequency greater than 25 kHz, thereby eliminating any flicker during start or operation.
5. The circuit allows for all varying inputs by simply removing or installing one jumper cable. The same basic circuit is applicable to drive 4, 5, or 6 lamps at one time. Each lamp has its current controlled by an individual circuit element.

6. The electronic ballast will provide "instant on" with no startup flicker.
7. There will be no audible ballast hum.
8. The circuit design includes electromagnetic interference filtration, surge protection, and inrush current limiting.

5. Reference and Prior Art Statement

The inventors have also researched the literature and discuss the following patents which may be construed as having somewhat similar function:

1. U.S. Pat. No. 4,370,600 by Zansky describes a two wire electronic circuit for controlled dimming of the lamps from zero to maximum. This design utilizes additional windings of the transformer to control lamp current. It discloses circuit diagrams for a high frequency solid state dimmable fluorescent ballast which utilizes a resonant bridge invertor to provide high frequency sinusoidal power to the lamps. He includes a current limiting resistor in his disclosure.
2. U.S. Pat. No. 4,394,603 by Widmayer discloses an energy conserving system designed primarily for power savings. The concept and design is to have the intensity adjusted based on ambient light. The basic application is for overhead lighting and conservation of power. He discloses a starting circuit wherein a lamp and a resistor act as the ballast that limits the current. In some cases he describes a transistor ballast and control circuit to control current.
3. U.S. Pat. No. 4,525,648 by De Biji discloses a DC/AC converter using transistors and inductors along with zener diodes as frequency converters and also using timing circuits. This properly heats the lamp electrodes before the lamp ignites. It is not clear that the circuits act as ballasts.
4. U.S. Pat. No. 4,847,535 by Wisbey discloses a hybrid ballast to prevent electrical shock with lamps connected in series. The design basically limits the voltage at the connection to the lamp when one of the lamps in series is disconnected.
5. U.S. Pat. No. 4,937,502 by Pro describes an electronic ballast with a power circuit having magnetic transformers, parallel lamps and a FET circuit for fluorescent lights utilized in aircraft applications. Power factor is critical and controllable.
6. U.S. Pat. No. 4,996,462 by Krummel discloses electronic ballasts for fluorescent lamps. This design is strictly for the purpose of lowering the voltage requirement on a capacitor used in an electronic ballast.
7. U.S. Pat. No. 5,004,947 by Nilssen discloses an electronic ballast with a power circuit having magnetic transformers, parallel lamps and a FET circuit. This design varies the lamp current by means of a permanent magnet changing the flux density of the saturable transformer. Movement of the magnet around the transformer can change lamp current. He limits lamp current by a variable transformer that controls frequency which in turn controls current.
8. U.S. Pat. No. 5,004,959 by Nilssen discloses a fluorescent lamp ballast with adjustable lamp current. He limits current with a variable transformer that controls frequency which in turn controls current.

SUMMARY OF THE PRESENT INVENTION

The electronic ballast system of this invention is specifically designed to be used in ballast systems for ultraviolet lamps used in ultraviolet transilluminators and ultraviolet crosslinkers for biotech research. The main characteristics for the specified applications are higher output intensity than can be obtained with magnetic ballasts, power boost for momentarily increasing the ultraviolet lamp intensity over its normal output, ability to switch between banks of lamps with the same main circuitry of the ballast allowing switching of wavelengths, lighter weight, incremental switching of intensities, wide range of wattage with same ballast, wide range of input voltages and ease of installation or service. The electronic ballast unit with the capabilities outlined above provides features presently not available on the existing market.

BRIEF DESCRIPTION OF THE TABLES

Table 1 lists the materials used to produce the printed circuit board for transilluminators and crosslinkers.

Table 2 lists the materials used to produce the printed circuit board for variable intensity transilluminators.

Table 3 lists the materials used to produce the printed circuit board for the power boost option for transilluminators.

Table 4 lists the materials used to produce the printed circuit board for the triple wave option for transilluminators.

DETAILED DESCRIPTION OF THE ELECTRONIC BALLAST INVENTION

Figure 1:
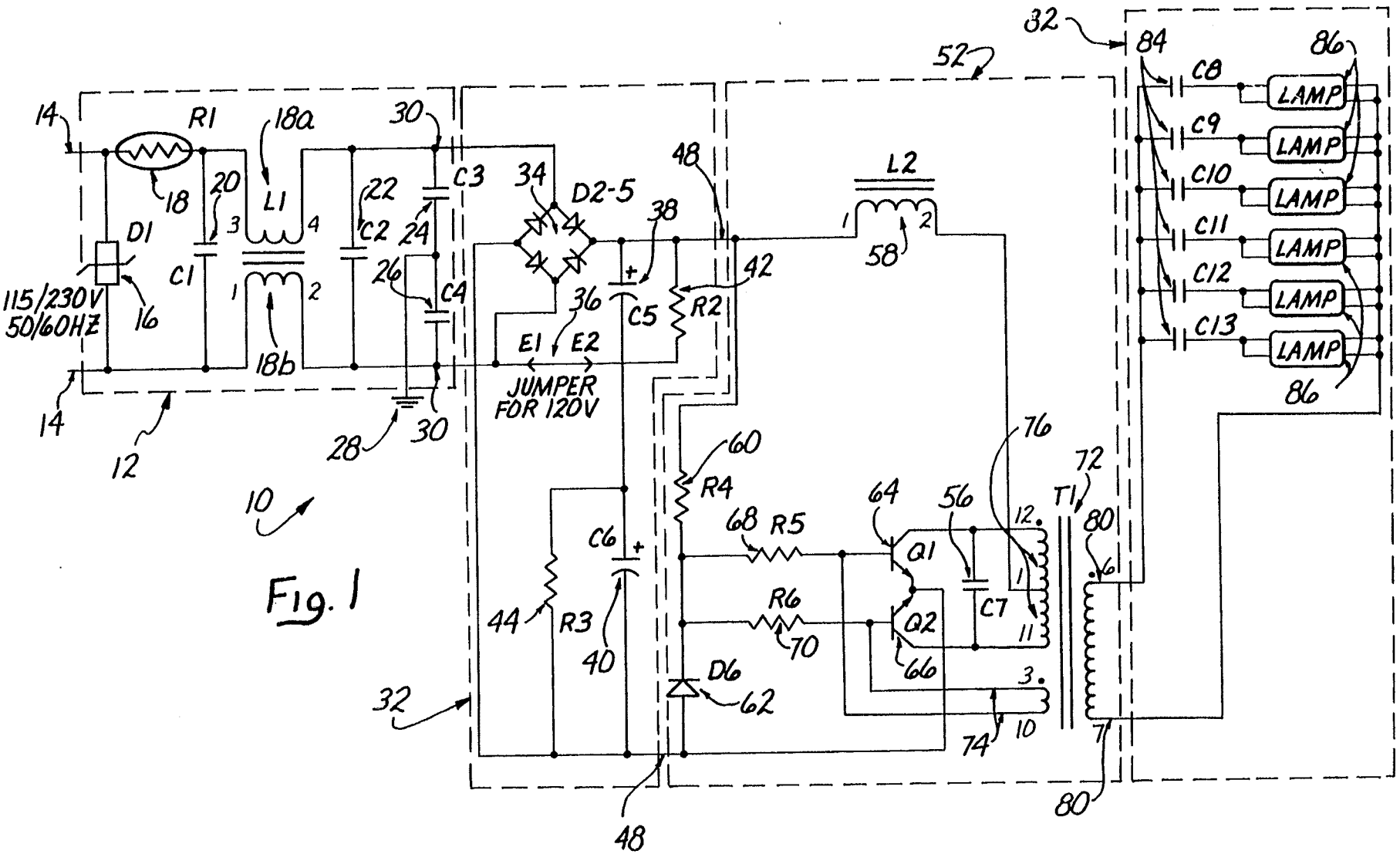
FIG. 1 is an electrical schematic circuit diagram of a preferred embodiment of the invention showing the input stage, the high frequency power supply stage and the lamp output ballast stage of an electronic ballast circuit.

The electronic ballast invention comprises a series of stages as described in FIG. 1.

Referring now to FIG. 1, the electronic ballast system 10, according to a preferred embodiment of the present invention and in which is a first stage comprised essentially an electro-magnetic interference filter (EMI) stage 12, having a set of input supply terminals 14, a metal oxide varister or diode 16, connected across the terminals 14, the diode 16, having a 275 volt breakdown rating that protects the electronic ballast circuit components in the electronic ballast system 10, from line voltage transients which may occur. A surge limiter resistance 18, with inductance 18*a*, and inductance 18*b*, is seen used to reduce an inrush of current when power is initially applied to the system 10, as when the sine wave of the power is at a peak value of the alternating current cycle and a discharge capacitor 38, 40, of a rectifier circuit of a subsequent stage could draw very high inrush current. The internal resistance of resistor 18, varies inversely with its operating temperature and it has a resistance value of approximately 5 ohms at room temperature. Resistor 18, tends to warm up to its operating temperature by its internal resistance heating due to current passing through it, thereby reducing the inrush current by a factor of approximately 10. This surge limiting action prevents burnout of components in the system 10.

Capacitors 20, 22, act as filters in a EMI differential mode, and series capacitors 24, 26, are connected across the terminals 14, as shown to act as a filter for common mode EMI and, with capacitors 20, 22, filter and discharge to ground 28. Thus, it is seen the EMI filter stage 12, reduces two types of EMI generated in and received from the power line on terminals 14. The common mode EMI is defined as the noise between the input terminals 14, and the ground 28, while differential EMI is defined as that noise between the input terminals 14. Output terminals 30, 30, terminate the first or EMI filter stage 12.

Further referring to FIG. 1, there is a second or full wave bridge rectifier stage 32, connected responsive to terminals 30, 30, of the EMI filter stage 12, and provides input to opposite corners of bridge rectifier 34. When E1–E2 jumper 36, is shorted, as shown, across its terminals E1, E2, incoming voltage across capacitors 38, 40, is essentially doubled to provide approximately 300 volts DC at the output of the bridge rectifier 34, to assure that the ballast system 10, gets the same voltage regardless of the input voltage being 110 VAC or 220 VAC. When the E1–E2 jumper 36, is open, the rectifier stage 32, becomes a conventional full wave rectifier which rectifies the AC on the terminals 30, 30, to produce approximately 300 volts DC. The jumper 36, provides the input supply to the electronic ballast system 10, to be either 115 volts with the E1–E2 jumper 36, in place, or 230 volts with the E1–E2 jumper 36, removed. A jumper is defined merely as a short wire or member used to close a break or to cut out a portion of a circuit.

Connected across respected capacitors 38, 40, are resistors 42, 44, used to provide discharge of respective capacitors 38, 40, for safety after the input is turned off so that no power would be stored in the capacitors 38, 40, to cause a shock hazard, as well as to provide ballast to turn off quickly a load such as the lamps 86, to be described below. Output connections 48, 48, terminate the rectifier stage 32.

Continuing to refer to FIG. 1, a third or electronic ballast circuit stage 52, receives input from output connections 48, 48, and which comprises basically a resonant DC to AC converter running at approximately 35 to 40 kHz in which a resonance is achieved in a circuit comprising therewith a resonant capacitor 56, an inductance or choke of a metal core would with wire to establish an inductance given as a resonant choke 58, to establish the above stated resonant frequency. A resistor 60, connected with diode 62, across connections 48, 48, is used to apply a starting bias applied to transistors 64, 66, while diode 62, provides reverse current protection on or to the bases of transistors 64, 66, as a clamp in case of transients. Resistors 68, 70, are so connected to provide limited base current protection on the transistors 64, 66.

In the ballast circuit stage 52, is included transformer 72, with winding 74, providing feedback to maintain oscillation of the ballast circuit stage 52, and once the bias is applied to the transistors 64, 66, one of the transistors turns on harder than the other, which starts the oscillation. The capacitor 56, and the impedance of primary winding 76, of the transformer 72, form an inductance that sets or establishes the resonant frequency which is a generally pure sine wave of 35 to 40 kHz and 1500 volts peak to peak, or approximately 500 volts RMS at output terminals 80, 80, of the third or ballast circuit stage 52. Output connections of the third stage 52, are the terminals 80, 80.

A fourth or ballast output stage 82, of the electronic ballast circuit stage 10, includes receiving input from the terminals 80, 80, which is applied across at least one of a plurality of series connected capacitors 84, and fluorescent lamps 86. The capacitors 84, provide capacitive ballast and impedance at the resonant frequency such that the lamp(s) 86, so that the fluorescent lamp current is limited and ballasted at a value of voltage sufficiently high enough to start the lamps 86, which voltage is applied before the lamps draw significant current, and is configured to provide instant start for the lamps.

Figure 2:
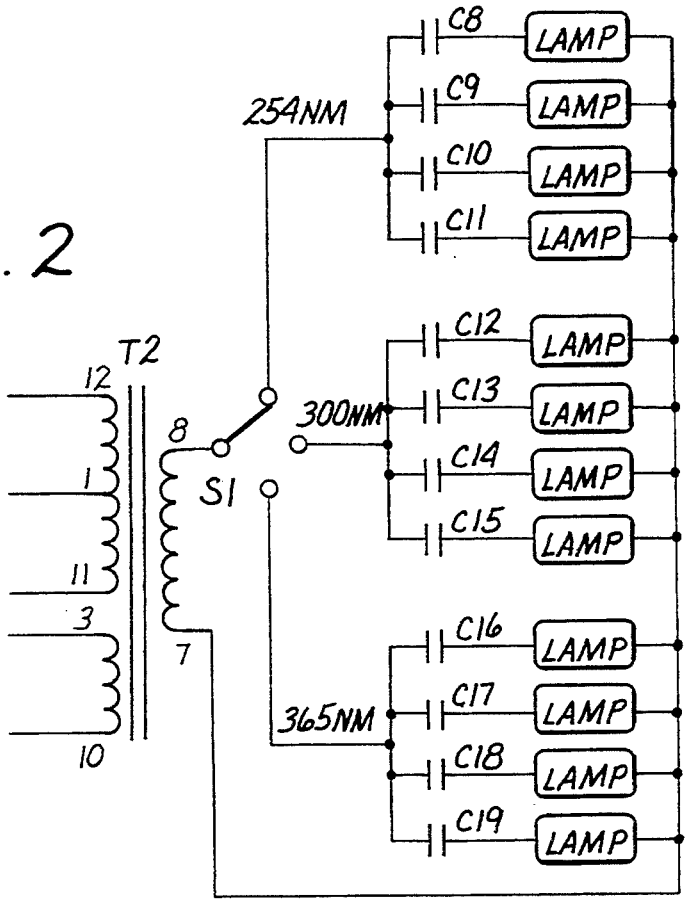
FIG. 2 is an electrical schematic circuit diagram of a variable lamp output ballast stage of FIG. 1 which allows switching to banks of lamps of variable wave length.

FIG. 2 shows how banks of multiple wavelength lamps can be powered by the invention. The schematic shows how the capacitive ballasts can be switched between banks of lamps allowing multiple wave lengths capability within one electronic ballast unit. Each of the banks of lamps can be a different wavelength. This feature allows the user to switch different wavelengths without disassembly of a unit to change the lamps.

Referring now to the schematic illustrated in FIG. 2, power from the transformer terminal 8, flows through a multi-contact single pole switch (or relay) S1, to any number of contacts which lead to ballast capacitors. In this schematic three different banks of capacitors are illustrated. One bank of capacitors (C8, C9, C10 & C11), and fluorescent lamps are identified as Bank A. This bank is labeled 254 nm (nanometers) which represents the wavelength output of the lamps on Bank A. A second bank of capacitors (C12, C13, C14 & C15), and fluorescent lamps are identified as Bank B. This bank is labeled 300 nm which represents the wavelength output of the lamps on Bank B. A third bank of capacitors (C16, C17, C18 & C19), and fluorescent lamps are identified as Bank C. This bank is labeled 365 nm which represents the wavelength output of the lamps on Bank C. Switch S1, can be used to select any one of the groups of lamps without manually changing lamps thereby providing variable wavelength lamp output by turning a selector switch or by energizing a relay operated switch.

Figure 3:
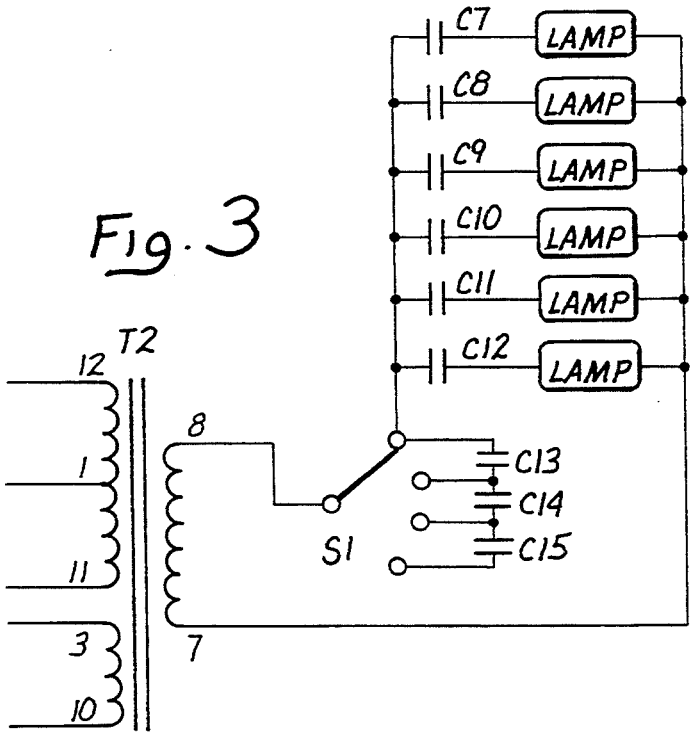
FIG. 3 is an electrical schematic circuit diagram of a variable output stage which allows switching of one or more capacitors in series with each other in series with the ballasts to vary intensity of the lamps.

FIG. 3 shows how lamp current and lamp output intensity can be controlled by the invention. Most available variable electronic ballasts provide intensity variability ranging from 0 to 100%. In the electrophoresis application variation to zero intensity is not needed and only a limited range of intensity variation in step form is required.

FIG. 3 shows a method of placing additional capacitors in series with the existing ballast capacitors which will reduce the overall capacitor value thus reducing the current through the lamps and correspondingly reducing the lamp intensity. The schematic of FIG. 3 shows how a group of capacitors, identified as C13, C14 and C15, connected in series can be switched on in series with capacitive ballasts (C7, C8, C9, C10, C11 and C12), allowing step changes in overall capacity. This changes the lamp current and intensity within one electronic ballast unit.

Figure 4:
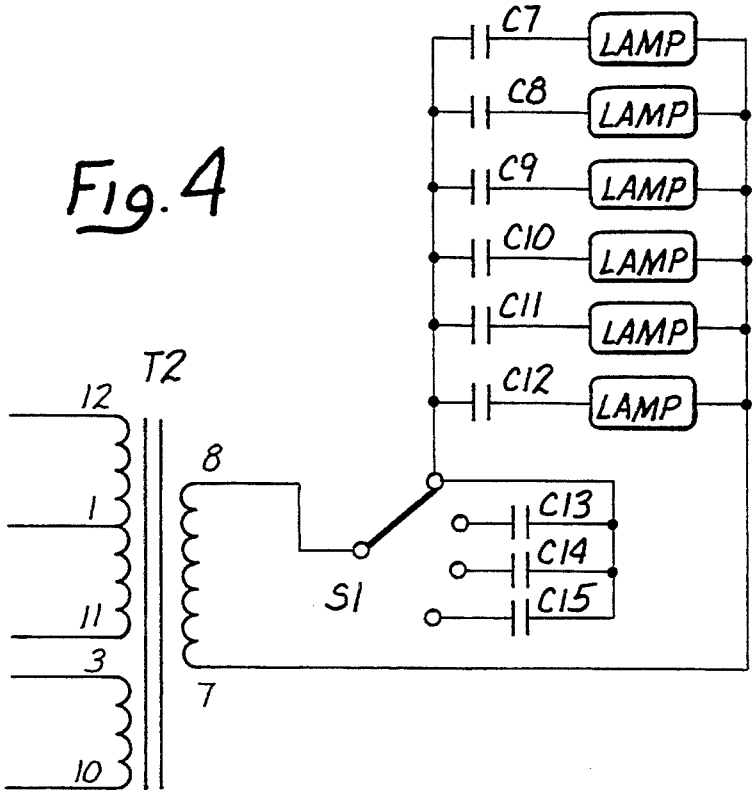
FIG. 4 is an electrical schematic circuit diagram of a variable output stage which allows switching individual capacitors in series with the ballasts to vary intensity of the lamps.

FIG. 4 shows another method of placing additional capacitors in series with the existing ballast capacitors which will reduce the overall capacitor value thus reducing the current through the lamps and correspondingly reducing the lamp intensity. The additional capacitors (C13, C14 and C15), are each connected in parallel to a line leading to the ballast capacitors (C7 through C12). The transformer output from terminal 8, routed through single pole multiple contact switch S1, can put any one of the additional capacitors (C13, C14 and C15), in series with the group of capacitive ballasts (C7, C8, C9, C10, C11 and C12), allowing step changes in overall capacity. This changes the lamp current and intensity within one electronic ballast unit.

Figure 5:
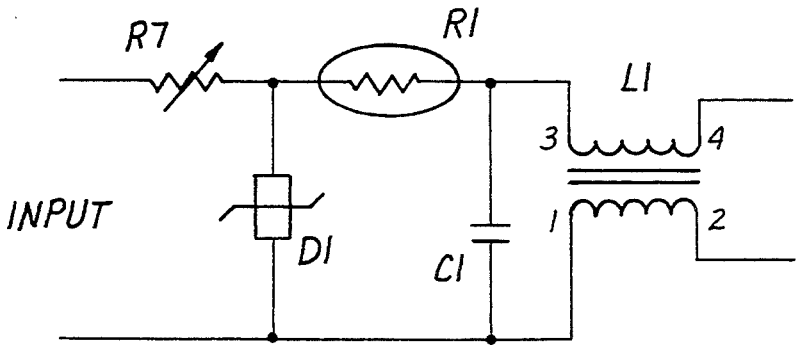
FIG. 5 is an electrical schematic circuit diagram of a variable input stage which allows a variable resistor on the input line to provide variable intensity of the lamps.

FIG. 5 shows how lamp current and lamp output intensity can be controlled by a variable resistance R7, on the input circuit, allowing the variable reduction of input voltage, thereby reducing the current to the lamps.

Figure 6:
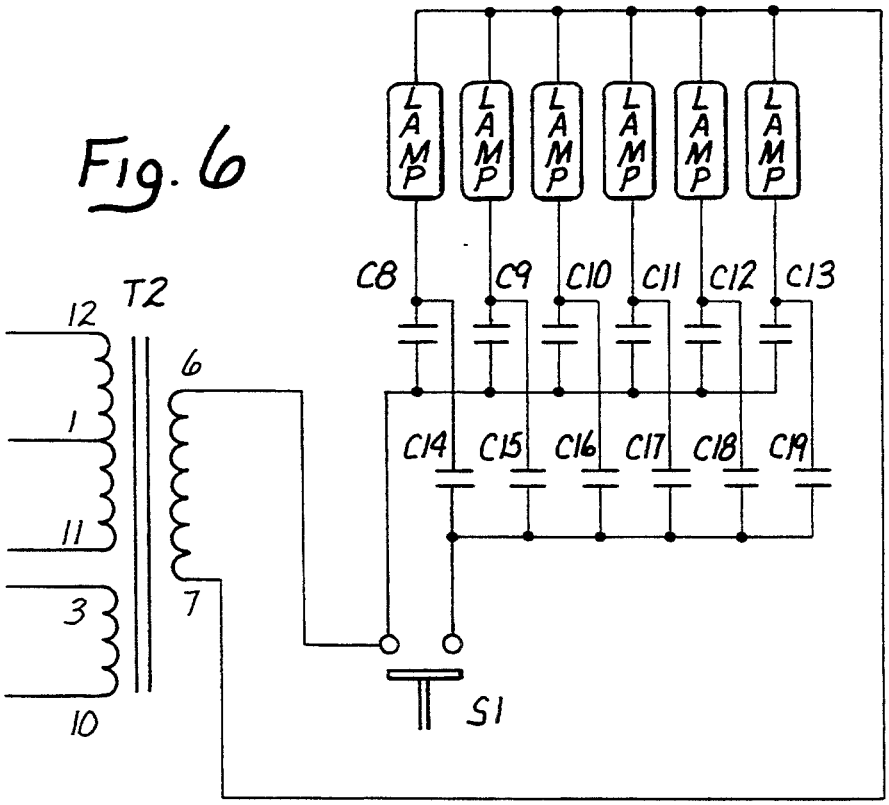
FIG. 6 is an electrical schematic circuit diagram of a power boost variable ballast output stage which allows the operator to momentarily increase the capacitance of the ballast which increases intensity of the lamps.

FIG. 6 shows how lamp current and lamp output intensity can be boosted above normal for short periods of time. This power boost feature operates by closing switch S1, to switch output power to a parallel group of capacitors (C14, C15, C16, C17, C18 and C19), to cause momentary paralleling of ballast capacitors C8, through C13, thereby increasing the value of the ballast capacitors which will increase the current through the lamps. In the electrophoresis measurement application only a short period of increased power is required for photographic purposes or for fast visualization because extended boost time would shorten the life of the lamps.

Figure 7:
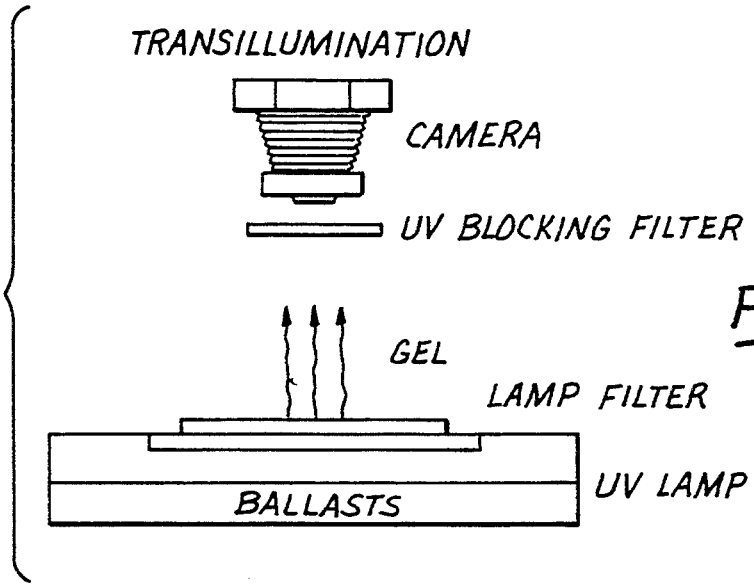
FIG. 7 is a schematic diagram of a transilluminator showing a preferred arrangement of the electronic ballast and other necessary components.
Figure 8:
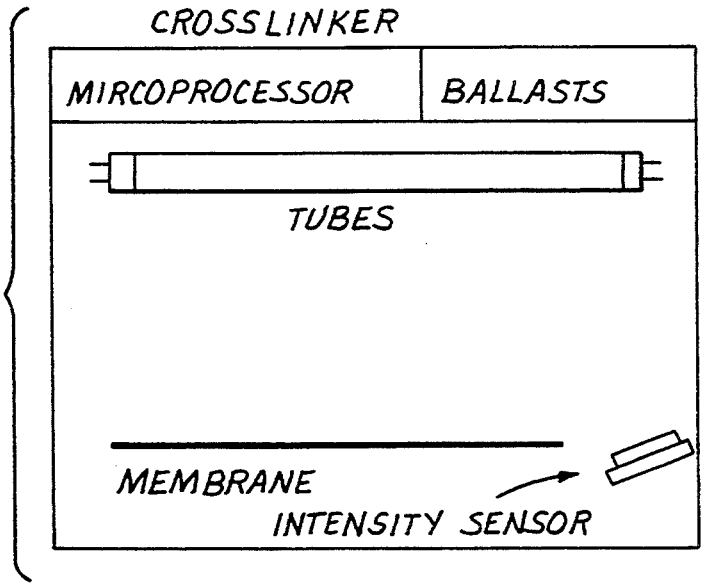
FIG. 8 is a schematic diagram representation of the crosslinker setup showing a preferred arrangement of the electronic ballast and other components as shown.

FIG. 7 indicates the setup used with transilluminators and FIG. 8 shows the setup used with crosslinkers.

Crosslinking equipment uses an enclosed cabinet with short wave tubes (245 nm) and times the ultraviolet exposure process with a microprocessor control. These units utilize intensity sensing cells to determine the output of the lamps. This intensity signal is fed back to the microprocessor and calibrated against time to provide automatic microJoule or time settings. The unit can be programmed to provide the consistent microJoule output to the membrane. As the ultraviolet lamp output decreases, the microprocessor automatically adjusts the exposure time for a constant microJoule output.

STATE OF THE ART

1. ULTRAVIOLET TRANSILLUMINATORS

Ultraviolet transilluminators presently on the market are basically light boxes using ultraviolet lamps in the following configurations:

1. 6 15 watt tubes,
2. 4 15 watt tubes,
3. 4 6 watt tubes,
4. 5 8 watt tubes.

The variations in configuration are influenced by cost, gel sizes, the types of samples and the ultraviolet intensity required.

Features of these ultraviolet transilluminators with electronic ballasts are:

1. Output intensity (flux),
2. Intensity control,
3. Area of exposure,
4. Small physical size of units.

2. ULTRAVIOLET CROSSLINKERS

The ultraviolet crosslinker is basically an ultraviolet oven using ultraviolet lamps to bake various membranes. The lamp arrangement presently on the market are:

1. 5–15 watt tubes,
2. 6–15 watt tubes,
3. 5–8 watt tubes.

The reasons for the varying tubes are size requirements and cost. Features of the ultraviolet crosslinker with electronic ballasts are:

1. Automatic intensity programming in microJoules,
2. Safety interlocks,
3. Level of intensity and variation available,
4. Minimal bench space required,
5. Microprocessor exposure control.

3. OTHER FEATURES OF TRANSILLUMINATORS AND CROSSLINKERS

Other features of the transilluminators and crosslinkers with electronic ballasts are:

1. Safety interlocks,
2. Amount of intensity (flux) available,
3. Low weight,
4. Improved serviceability,
5. Minimal bench space required.

ADVANTAGES OF THE CONSTRUCTION OVER PREVIOUS DESIGNS

The advantages of this construction over previous designs are as follows:

1. Cost of construction is low due to the simple circuitry, the use of standard components and circuit board wiring.
2. The ability for one electronic ballast design to accept either 120 VAC or 220 VAC input voltage by merely connecting or disconnecting a jumper or by operating a switch. This system allows the user, the seller or the installer to make changes in line voltage rating of the electronic ballast.
3. Reliability and reduced maintenance are assured by using circuit board construction in place of the common external wiring and metal chassis construction that are commonly used in the industry.
4. The ultraviolet fluence of the fluorescent lamps connected to the invention is repeatable with very short pulse type operation because of the high frequency ballast operation thereby making electrophoresis measurements more precise than previously possible and provide for easier visualization of gels.
5. There will be no starting flicker of the ultraviolet lamps connected to the invention thereby providing faster visualization at higher intensities and making electrophoresis measurements more precise than previously possible.

6. There will be no audible hum from the ballast invention thereby eliminating unwanted/annoying audible noise in the research laboratory.
7. Because the electronic ballast invention is small, light and efficient, the internal heating of the transilluminator/crosslinker will be reduced.
8. Because the output of the electronic ballast can be controlled by simple switches and/or by change in capacitors/resistors, a single electronic ballast design can be used to control a number of different sizes of ultraviolet lamps thereby increasing versatility and reducing the need for building and stocking different models.

ALTERNATE DESCRIPTION OF THE ELECTRONIC BALLAST INVENTION

An alternate description of the electronic ballast invention is given below:

1. The invention is an electronic ballast for use with crosslinkers and transilluminators comprising:
   (a) a first stage comprising an inrush current limiting means and an EMI filter means,
   (b) a second stage comprising a full wave bridge rectifier means, a supply voltage compensating means and a safety residual power discharge means,
   (c) a third stage comprising a resonant DC to AC converter means and
   (d) a fourth output stage comprising capacitive ballasts to provide an impedance at the resonant frequency such that the fluorescent lamp current is limited and provides an instant start configuration.
2. The electronic ballast of Paragraph 1 in which the circuitry is capable of operating with input voltages ranging from 85 volts AC to 250 volts AC and input frequencies ranging from 40 Hertz to 400 Hertz.
3. The electronic ballast of Paragraph 1 in which the output to fluorescent ultraviolet lamps comes from a group of capacitors which control the current to the lamps.
4. The electronic ballast of Paragraph 1 in which the output to fluorescent ultraviolet lamps comes from a primary group of capacitors in parallel with alternate sets of capacitors which can be momentarily switched in parallel with the primary capacitors to achieve a momentary power boost.
5. The electronic ballast of Paragraph 1 in which the output to fluorescent ultraviolet lamps comes from a primary group of capacitors in parallel with alternate sets of capacitors which can be switched in series with the primary capacitors to achieve a variable intensity of fluorescent ultraviolet lamp intensity.
6. The electronic ballast of Paragraph 1 in which the output to fluorescent ultraviolet lamps comes from a primary group of capacitors in series with a variable resistor means to achieve a variable intensity of fluorescent ultraviolet lamp intensity.
7. The electronic ballast of Paragraph 1 in which the output to fluorescent ultraviolet lamps comes from a group of capacitors in parallel which can be changed to provide the required current for various fluorescent ultraviolet lamps.
8. The electronic ballast of Paragraph 1 with means for starting and operating four or more fluorescent ultraviolet lamps simultaneously.
9. An electronic ballast for use with crosslinkers and transilluminators with a first stage comprising an inrush current limiting resistor means with its resistance substantially inversely proportional to operating temperature to limit electrical current to preset values.
10. An electronic ballast for use with crosslinkers and transilluminators with a first stage comprising an electromagnetic interference filter means to reduce supply line current/voltage transients to tolerable levels.
11. An electronic ballast for use with crosslinkers and transilluminators with a first stage comprising an electromagnetic interference filter means to reduce supply line current/voltage transients to tolerable levels.
12. An electronic ballast for use with crosslinkers and transilluminators with a final stage output operating frequency equal to or greater than 25 kilohertz to eliminate flicker and provide instant startup of fluorescent ultraviolet lamps.

PREFERRED EMBODIMENT

The preferred embodiments for the invention used components as specified in Tables 1 to 4 to fabricate the apparatus. Thickness of the metal and plastic components are unimportant. The outer covers were fabricated from corrosion resisting stainless steel. This was selected because of its appearance, strength, formability, machineabilty and corrosion resistance. The circuit board was a standard commercial item described in the tables. The ultraviolet lamp holders, cooling fan and other electrical components were also standard commercial parts described in the Tables 1 to 4.

The commercially available ultraviolet lamps, part number F15T8E 15 Watt from Tech-West are cylindrical tubular lamps 11–12 mm in diameter that are available from various manufacturers. These lamps emit the proper 300 nm spectral response for transilluminators. The ultraviolet lamp reflector is manufactured from 0.020 inch thick commercially available Coilzak material which is commonly used in such applications.

While certain exemplary embodiments of this invention have been described above and are shown in the accompanying drawings, it is to be understood that such embodiments are merely illustrative of, and not restrictive on, the broad invention and that we do not desire to be limited in our invention to the specific constructions or arrangements shown and described, because various other obvious modifications may occur to persons having ordinary skill in the art.

TABLE 1

BILL OF MATERIALS
ELECTRONIC BALLAST FOR TRANSILLUMINATORS AND CROSSLINKERS
PRINTED CIRCUIT BOARD

| ITEM NO. | DESCRIPTION | REF/DES | PART NO. | VENDOR | QTY. |
|---|---|---|---|---|---|
| 1 | PC Board | | 78-0003-01 | Wesco | 1 |
| 2 | Ballum | LI | PLK1001 | Digi-Key | 1 |
| 3 | Diode | D2-5 | 1N5404 | Digi-Key | 4 |

TABLE 1-continued

BILL OF MATERIALS
ELECTRONIC BALLAST FOR TRANSILLUMINATORS AND CROSSLINKERS
PRINTED CIRCUIT BOARD

| ITEM NO. | DESCRIPTION | REF/DES | PART NO. | VENDOR | QTY. |
|---|---|---|---|---|---|
| 4 | Diode | D6 | 1N4933 | Digi-Key | 1 |
| 5 | Power Transistor | Q1,2 | BU508A | SGS | 2 |
| 6 | MOV | D1 | P7091 | Digi-Key | 1 |
| 7 | Surge Resistor | R1 | KC015L-ND | Digi-Key | 1 |
| 8 | Capacitor | C5,6 | 220UF,250V | Tecate | 2 |
| 9 | Choke | L1 | 40-0005-01 | Stand. Mag. | 1 |
| 10 | Transformer | T1 | 40-0006-01 | Stand. Mag. | 1 |
| 11 | Capacitor (15W) | C8-13 | .0025UF,2KV | Roederstein | 6 |
| 12 | Capacitor | C7 | .0068UF,2.5KV | Roederstein | 1 |
| 13 | Capacitor (8W) | C8-12 | .0012UF,2KV | Roederstein | 5 |
| 14 | Resistor | R4 | 10K OHM,10W | Mouser | 1 |
| 15 | Resistor | R2,3 | 47K OHM,1W | Mouser | 2 |
| 16 | .11" Terminals | E1-2 | 153-1006 | Mouser | 2 |
| 17 | Heat Sink | FOR Q1,2 | HS120-ND | Digi-Key | 2 |
| 18 | Capacitors | C1,2 | .1UF,630V | Digi-Key | 2 |
| 19 | Capacitors | C3,4 | 4700PF,UL Y | Digi-Key | 2 |
| 20 | Resistor | R5,6 | 220 OHM,½W | Mouser | 2 |
| 21 | Stand Off | | .375" 6X32 | Mouser | 6 |
| 22 | 8 Term Bar | J2 | 506-3PCV-08 | Mouser | 1 |
| 23 | 2 Term Bar | J1 | 506-3PCV-02 | Mouser | 1 |

TABLE 2

BILL OF MATERIALS
ELECTRONIC BALLAST ASSEMBLY FOR VARIABLE INTENSITY
TRANSILLUMINATORS

| ITEM NO. | DESCRIPTION | REF/DES | PART NO. | VENDOR | QTY. |
|---|---|---|---|---|---|
| 1 | Lighted Power on | S2 | SPST Switch | Westgard | 1 |
| 2 | 4 Pos. Rotary | S1 | SP4Pos. | Calswitch | 1 |
| 3 | Capacitors | C13–15 | .0025UF,2KV | Roederstein | 3 |
| 3 | Chassis T-Lum .060 CRS | | 12-0018 | SRD | 1 |
| 4 | Cover T-Lum .060 CRS or Brushed Stainless Steel | | — | SRD | 1 |
| 5 | Reflector T-Lum .020 Coilzak | | 16-0025-01 | SRD | 1 |
| 6 | UV Tubes | F15TSE | 15 Watt 300 nm | Tech-West | 6 |
| 7 | Lamp Holders | | 590BBR-7 | Kulka | 12 |
| 8 | Wire | Stranded | 18 Gage | Storm | |
| 9 | Fan | Etri | 3" | Component Cent | 1 |
| 10 | Fuse Holder | | | Kraut & Baux | 2 |
| 11 | Fuse | Time Delay | 2 Amp | Little Fuse | 2 |
| 12 | Power Cord | Intern. Cord | | Component Cent | 1 |
| 13 | Power Receptacle | Dual Fuse | | Kraut & Baux | 1 |
| 14 | Electronic Ballast PC Board | | | | 1 |

TABLE 3

BILL OF MATERIALS
ELECTRONIC BALLAST POWER BOOST OPTION FOR TRANSILLUMINATORS

| ITEM NO. | DESCRIPTION | REF/DES | PART NO. | VENDOR | QTY. |
|---|---|---|---|---|---|
| 1 | PC Board | | 78-0025-01 | Wesco | 1 |
| 2 | Capacitors | C14–C19 | .0012UF,2KV | Roederstein | 6 |
| 3 | Push Button | S1 | SPST PB | Wesdgarde | 1 |
| 4 | Wire | Stranded | 18 Gage | Storm | |

TABLE 4

BILL OF MATERIALS
ELECTRONIC BALLAST TRIPLE WAVE OPTION FOR TRANSILLUMINATORS

| ITEM NO. | DESCRIPTION | REF/DES | PART NO. | VENDOR | QTY. |
|---|---|---|---|---|---|
| 1 | PC Board | | 78-0025-01 | Wesco | 1 |
| 2 | 3 Pos Rotary Sw. | | 1P3POS | Westgarde | 1 |
| 3 | Capacitors | C14–C20 | 0.0012UF 2KV | Roederstein | 7 |
| 4 | Reflectors | | 16-0026-01 | SRD | 2 |
| 5 | Brackets | | 20-0149-01 | SRD | 2 |
| 6 | UV Tubes | G8T5 | 8 Watt 254 nm | Tech-West | 5 |
| 7 | UV Tubes | F8T5BL | 8 Watt 365 nm | Tech-West | 4 |

TABLE 4-continued

BILL OF MATERIALS
ELECTRONIC BALLAST TRIPLE WAVE OPTION FOR TRANSILLUMINATORS

| ITEM NO. | DESCRIPTION | REF/DES | PART NO. | VENDOR | QTY. |
|---|---|---|---|---|---|
| 8 | UV Tubes | FL8E | 8 Watt 300 nm | Tech-West | 4 |
| 9 | Chassis | | 12-0018 | SRD | 1 |
| 10 | Cover | | — | SRD | 1 |
| 11 | Filter Glass | U-325C | 20 cm × 20 cm | Hoya | 1 |
| 12 | Filter Glass | Longwave | 20 cm × 20 cm | Kokomo | 1 |
| 13 | Lamp Holders | | 659-A4 | Triborro | 26 |
| 14 | Wire | Stranded | 18 Gage | Storm | |
| 15 | Fuse | Time Del. | 2 Amp | Little Fuse | 2 |
| 16 | Fuse Holders | | | Kraut & Baux | 2 |
| 17 | Power Receptacle | | | Kraut & Baux | 1 |
| 18 | Power Cord | Intern. Cord | | Component Cent. | 1 |

Table 4 Notes:
1. PC Board material is .062" thick, GT-Glass CEM-1,2 oz copper.
2. A single pole single throw switch can be used in place of jumper E1–E2 for switching from 115VAC to 230VAC.
3. A variable Potentiometer on the input can be used in place of the capacitors for varying the intensity:
For 115 volts, use $R_{max}$ = 110 ohms 50 watts C & H Sales,
For 230 volts, use $R_{max}$ = 100 ohms 50 watts C & H Sales.

What is claimed is:

1. An electronic ballast for use with crosslinkers and transilluminators comprising:

(a) a first stage comprising an inrush current limiting means and an EMI filter means, (b) a second stage comprising a full wave bridge rectifier means, a supply voltage compensating means and a safety residual power discharge means, (c) a third stage comprising a resonant DC to converter means and (d) a fourth output stage comprising capacitive ballasts to provide an impedance at the resonant frequency such that fluorescent lamp current is limited and provides an instant start configuration.

2. The electronic ballast of claim 1 in which the circuitry is capable of operating with input voltages ranging from 85 volts AC to 250 volts AC and with input frequencies ranging from 40 Hertz to 400 Hertz.

3. The electronic ballast of claim 1 in which the output to fluorescent ultraviolet lamps comes from a group of capacitors which control the current to the lamps.

4. The electronic ballast of claim 1 in which the output to fluorescent ultraviolet lamps comes from a primary group of capacitors in parallel with alternate sets of capacitors which can be momentarily switched in parallel with the primary capacitors to achieve a momentary power boost.

5. The electronic ballast of claim 1 in which the output to fluorescent ultraviolet lamps comes from a primary group of capacitors in parallel with alternate sets of capacitors which can be switched in series with the primary capacitors to achieve a variable intensity of fluorescent ultraviolet lamp intensity.

6. The electronic ballast of claim 1 in which the output to fluorescent ultraviolet lamps comes from a primary group of capacitors in series with a variable resistor means to achieve a variable intensity of fluorescent ultraviolet lamp intensity.

7. The electronic ballast of claim 1 in which the output to fluorescent ultraviolet lamps comes from a group of capacitors in parallel which can be changed to provide the required current for various fluorescent ultraviolet lamps.

8. The electronic ballast of claim 1 with means for starting and operating four or more fluorescent ultraviolet lamps simultaneously.

9. The electronic ballast of claim 1 for use with crosslinkers and transilluminators wherein the first stage comprises an inrush current limiting resistor means with its resistance substantially inversely proportional to operating temperature to limit electrical current to preset values.

10. The electronic ballast of claim 1 for use with crosslinkers and transilluminators wherein the first stage comprises an electromagnetic interference filter means to reduce supply line current/voltage transients to tolerable levels.

11. The electronic ballast of claim 1 for use with crosslinkers and transilluminators wherein a final stage output operating frequency is equal to or greater than 25 kilohertz to eliminate flicker and provide instant startup of fluorescent ultraviolet lamps.

12. An electronic ballast system for use with crosslinkers and transilluminators comprising:

(a) a pair of terminals for receiving an application of AC power, a metal oxide varister with breakdown characteristics connected across the pair of terminals, a surge limiting resistor with connections through inductance means and capacitor means therewith, to output connections defining a first stage, (b) a bridge rectifier having first opposite terminals responsive to current disposed on the output connections, voltage doubling capacitors connected across other opposite terminals of the bridge rectifier, and resistors coupled across the voltage doubling capacitors coupled to terminals providing an output defining a second stage, (c) a resonant circuit coupled to the output of the second stage including a resonant choke, a resonant capacitance, a portion of a transformer primary, and transistor means comprising an oscillator coupled so the secondary of the transformer has terminals providing an output defining a third stage, and (d) a plurality of capacitor-fluorescent lamp means connected to the output of the third stage to provide load means to the electronic ballast system.

13. The electronic ballast of claim 12 for use with crosslinkers and transilluminators wherein the first stage comprises an electromagnetic interference filter means to reduce supply line current/voltage transients to tolerable levels.

* * * * *